United States Patent [19]

Raab et al.

[11] 4,048,832

[45] Sept. 20, 1977

[54] SEPARATING DEVICE FOR REMOVING THE PRESS SKIN FROM A COMBINED EXTRUSION DISC

[75] Inventors: Richard Raab; Kurt Spindler, both of Rothenbach; Herbert Brand, Henfenfeld; Leonard Gast, Nurnberg, all of Germany

[73] Assignee: DIEHL, Nurnberg, Germany

[21] Appl. No.: 654,755

[22] Filed: Feb. 3, 1976

[30] Foreign Application Priority Data

Feb. 15, 1975 Germany ..... 2506447

[51] Int. Cl.[2] ..... B21C 23/00

[52] U.S. Cl. ..... 72/255; 225/93

[58] Field of Search ..... 29/225, 229, 200 D, 29/426, 427; 72/255, 254; 90/24C; 225/1, 93, 94

[56] References Cited

U.S. PATENT DOCUMENTS

| | | | |
|---|---|---|---|
| 3,112,560 | 12/1963 | Wagoner | 29/229 |
| 3,373,592 | 3/1968 | Robra et al. | 72/255 |
| 3,785,036 | 1/1974 | Tada et al. | 29/427 X |
| 3,808,590 | 4/1974 | Hemmer et al. | 29/427 X |
| 3,813,756 | 6/1974 | Rigsby | 29/229 X |

*Primary Examiner*—Frank T. Yost
*Attorney, Agent, or Firm*—Walter Becker

[57] ABSTRACT

A separating device for separating the ring-shaped press skin from a composite extrusion disc comprising a press disc and a stripper disc, especially for copper containing alloys and difficult to press metals and alloys, according to which the press disc is spaced from the stripper disc by an annular intermediate space for receiving the press skin. The device includes a separating head with a passage or recess into which project two blocks located opposite to each other. When the combined extrusion disc on its way through the passage passes between these blocks the projecting blocks enter the intermediate space for stripping off the press skin. The distance between the straight guiding means of the blocks is located within a range of from the length of the inner diameter of the combined extrusion disc to a length composed of the length of the inner diameter plus about the thickness of the press skin.

7 Claims, 12 Drawing Figures

SEPARATING DEVICE FOR REMOVING THE PRESS SKIN FROM A COMBINED EXTRUSION DISC

A combined disc for extrusion presses, especially for brass, has become known which comprises the press disc proper and a stripper disc associated therewith. Between these discs there is provided an annular space which during the pressing operation receives the contaminated outer skin of the metal block to be extruded. In order to permit the removal of this outer skin, henceforth called press skin, it has been suggested to provide between the discs axially directed webs which prevent a ring formation of the press skin so that the segment-shaped press skin sections could be removed manually. This solution, however, is rather expensive because the webs have to be welded-in and have to be renewed after they have worn off. Furthermore, these sections will stick to the disc and it is rather difficult to remove them from the disc.

It is, therefore, an object of the present invention to provide a device for removing the press skin in a relatively inexpensive manner with a minimum of wear of the device.

This object and other objects and advantages of the invention will appear more clearly from the following specification in connection with the accompanying drawings, in which.

Figure 3:
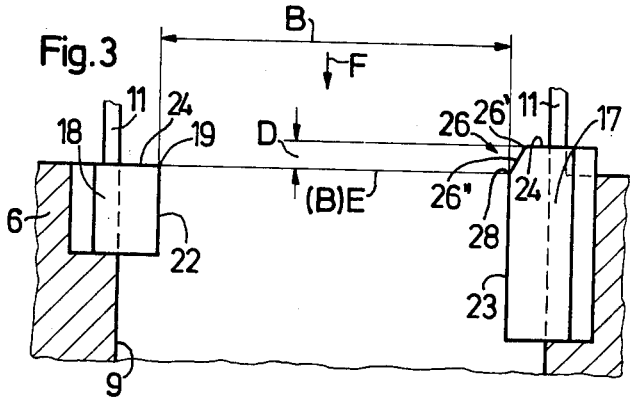

FIG. 3 diagrammatically illustrates a separating device according to the invention with a combination of blocks.

FIGS. 3*a* to 3*d* show individual working steps of the separating device of FIG. 3.

Figure 4:
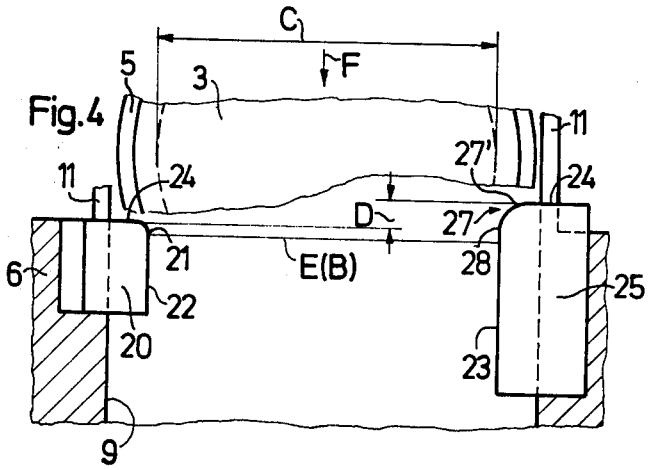

FIG. 4 shows a separating device with a different combination of blocks.

FIGS. 4*a* to 4*d* illustrate individual working steps of the separating device of FIG. 4.

The separating device according to the present invention, according to which the press disc is separated from the stripper disc by an annular space receiving the press skin, is characterized primarily in that two blocks arranged opposite to each other and corresponding in cross section to the cross section of the space between the discs extend into a compartment or cutout of the separating head. These blocks will, when the disc is driven by the separating ram and passes through the cutout or compartment, engage the space between the discs for ripping open and stripping off the press skin. The spacing between the guiding means for the blocks lies in a range between the inner diameter of the disc and a diameter composed of the inner diameter of the disc plus the thickness of the press skin. In this way, the press skin is in one operation completely separated from the combined disc.

By providing according to the present invention that the blocks have arcs arranged as images of each other and on opposite sides of a plane of symmetry, and that the space between said discs is contoured in conformity with said arcs, there is obtained the advantage that the press skin is removed even when a disc is turned by 180°. In this way, the operation is independent of any definite position of the combined disc on the separating device.

The press skins of easily extrudable alloys or alloys brittle when hot can easily be separated from the combined disc, if the blocks are provided with separating edges which extend transversely with regard to the direction of movement of the disc between said blocks and are located in one plane.

The invention also comprises separating devices according to which the blocks are offset relative to each other in the direction of the movement of the combined disc between said blocks, while the front block has a roll way leading between said blocks into a plane which extends transverse to the direction of movement of the combined disc between said blocks and which has a transition area merging with the straight guiding means, the rear block having a separating edge and a set-up surface. As a result of this design, the press skin is in one piece separated from the combined disc. If a two-piece separation should occur, it will be assured that by the degree of deformation of the pieces of press skin that the press skin pieces after the passage of the combined disc through the separating device are completely separated from the separating device and will be ejected by a successive disc.

Figure 1:
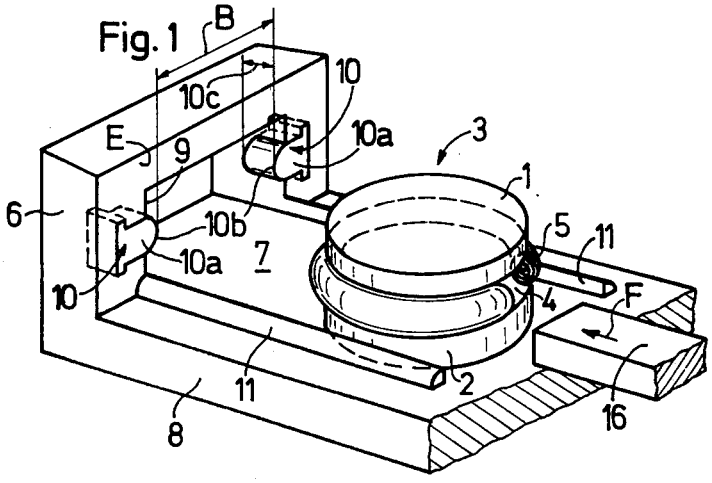
FIG. 1 illustrates a simplified separating device according to the invention.
Figure 2:
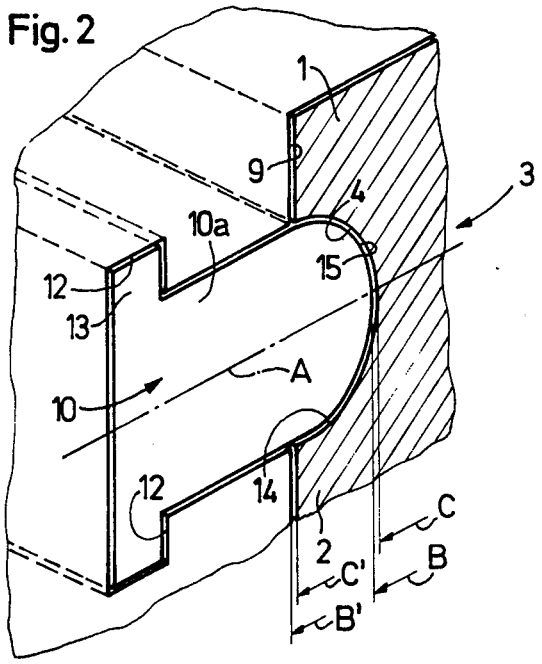
FIG. 2 shows on a larger scale than that of FIG. 1 a cutout of the latter according to which a block is located in an annular space of a combined disc.

Referring now to the drawings in detail, according to FIGS. 1 and 2, the disc 3 which is composed of a press disc 1, and a stripper disc 2 define an annular space 4 with a press skin 5 rolled up therein, the press skin being shown in partial section.

The disc 3 rests on a sliding path 7 of a framework 8 which comprises a separating head 6 with a compartment or cutout 9. Connected to the compartment or cutout 9 are two blocks 10 which extend into the space 4 between the press disc 1 and the stripper disc 3. These blocks 10, henceforth called separating blocks, are provided with upsetting surfaces 10*a*, separating edges 10*b*, and guiding means 10*c*. The sliding path 7 is defined by lateral guiding rails 11. According to FIG. 2 the separating block 10 has a flange 13 which is adapted to be slipped into T-shaped grooves 12 of the separating head 6. The cam surfaces 14, 15 of the separating blocks, which cam surfaces with slight play engage the space 4, are located as an image to each other with regard to the plane of symmetry A. The distance B between the two separating blocks 10 or guiding means 10*c* is slightly greater than the inner diameter C of the disc 3. Similarly, the distance B′ between the opposite walls of the compartment or cutout 9 is greater than the outer diameter C′ of the stripper disc 2 (FIGS. 3 and 4).

A mechanically driven separating ram 16 presses the press skin 5 in the direction of the arrow F together with the disc 3 into the compartment 9. The separating blocks 10 simultaneously enter the press skin 5 and rip the same open. The skin segment on the ram side is larger than the skin segment which has passed through between the blocks 10. The two skin segments drop off from the disc 3, and the disc 3 is again usable for a further extrusion pressing operation. This arrangement is suitable, for instance, for brass alloys, which are brittle when hot.

The separating edges 10*b* may be ground sharp or may be dull. At any rate, due to the guiding means 10*c* the ripping off of the press skin 5 is assured.

For purposes of separating a press skin which consists of an alloy that is adapted to be pressed only under difficulties, the device according to FIGS. 1 and 2 is insufficient. In such an instance, according to FIGS. 3 and 4, blocks are provided which are offset relative to each other by the distance D. With difficult to press brass the distance B is within the range of the inner diameter C of disc 3 and the inner diameter C plus one third of the average thickness of the press skin 5. As a result thereof the press skin 5 during its passage through the device is maintained on the block which is designed as roll block 17 (25) and does not tear off. In this way the press skin 5 can be stripped off from disc 3 in one piece.

The blocks connected to the separating head 6 are divided into the above mentioned roll block 17 (25) and a separating block 18 with a sharp edge 19, and a separating block 20 with a dull separating edge 21. The separating blocks 18, 20 and the roll block 17 (25) each have a guiding means 22, 23 and an upsetting surface 24.

The roll block 17 has a rolling path 26 with a short radius 26′, a straight section 26″, and a transition area 28. The roll block 25, on the other hand, has a rolling path 27 with large radius 27′ and a transition area 28.

In this connection it is important that the transition area 28, when viewed in the direction of the arrow F, is located either ahead of or in the plane E inasmuch as otherwise the disc 3 will be clamped-in between the blocks and cannot turn.

According to FIG. 3, the separating edge 19 is located in the plane E and, according to FIG. 4, the plane E is defined by the shortest distance B which, when looking in the direction of the arrow F, comes first. Also the separating edge 21 is located in the plane E.

To simplify the illustration of the ripping off process of the press skin 5, FIGS. 3*a* to 3*d* and FIGS. 4*a* to 4*d* show the disc 3 nearly with its smallest diameter in section, and the separating device is shown limited to the separation ram and the blocks.

Figure 3A:
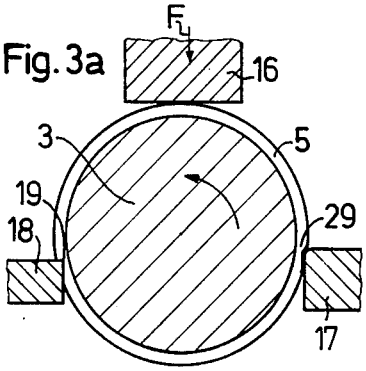
Figure 3B:
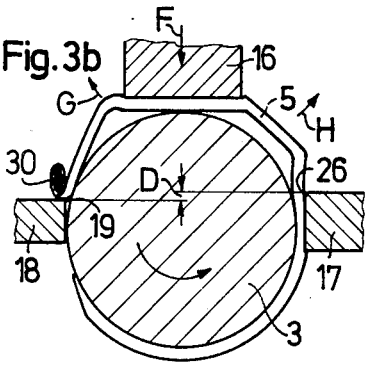

According to FIG. 3*a*, the separating ram 16 presses the disc 3 with the press skin 5 against the sharp-edged separating block 18 and the roll block 17. The press skin 5 is first compressed at the mentioned blocks and is compacted. After the separating ram 16 has been moved steadily in the direction of the arrow F, a wedge-shaped stopper 29 is formed on the roll block 18 between disc 3 and the inclined rolling path 26, the stopper or nodule being composed of the displaced and compacted press skin. As a result thereof, the resistance on the roll block 17 exceeds that on the separating block 18 with the sharp separating edge 19. Therefore, the disc 3 rolls in counterclockwise direction on the roll block 17 while the separating edge 19 penetrates the press skin 5 and cuts it open. Ahead of the separating block 18 the press skin chips accumulate and are compacted to form a nodule 30 (FIG. 3*b*). According to FIG. 3*b*, due to the press skin 5 being held on the blocks, the press skin 5 is in view of the counterclockwise rotation of disc 3 upset in front of the blocks and is bent in the directions of the arrows G, H. In other words, the press skin 5 is clamped-in between the separating ram 16 and the blocks, whereas the free section 31 of the ripped open press skin 5 is deformable by the disc 3.

Due to the forced relative rotation of the disc 3 relative to the press skin 5, the adhesion between the press skin 5 and disc 3 is eliminated.

Figure 3C:
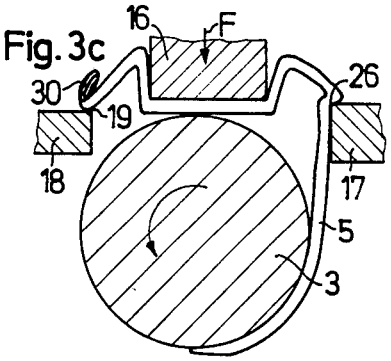

According to FIG. 3*c* the press skin 5 is still held between the separating ram and the blocks, and the disc 3 rolls on the bent section 31 of the press skin 5 and bends open the section 31.

Figure 3D:
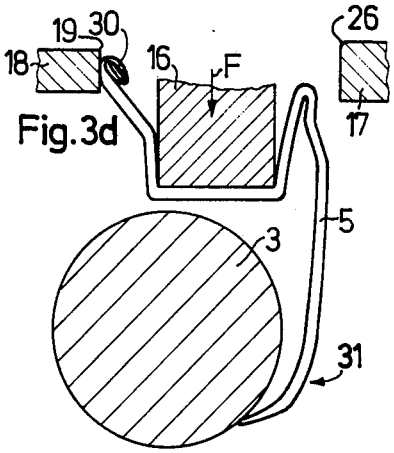
Figure 4A:
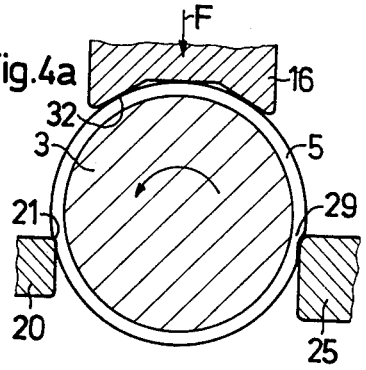
Figure 4B:
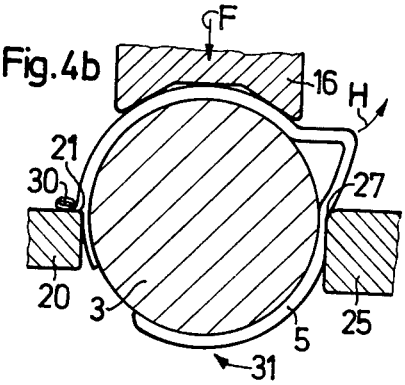
Figure 4C:
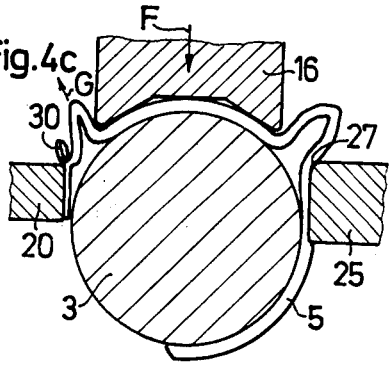
Figure 4D:
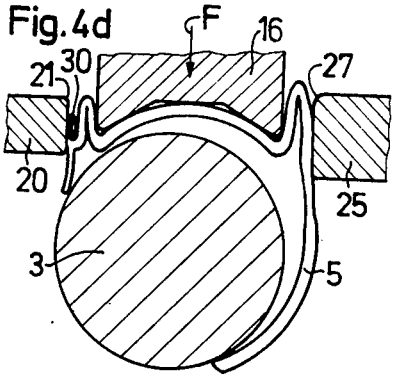

According to FIG. 3*d* the press skin 5 has been separated from the blocks and is subsequently by the separating ram 16 pushed out of the compartment 9 while the disc 3 is already separated from the press skin 5.

According to FIG. 4 the roll block 25 and the separating block 20 are inserted with a dull separating edge 21 into the separating head 6. The separating ram 16 is provided with a prismatic cutout or recess 32. Due to its low resistance relative to that of the rolling path 27, the separating edge 21 enters the press skin 5 and produces the nodule 30. In contrast to FIG. 3, according to FIG. 4*a* the press skin 5 is not cut open but is sheared off. The disc 3 rolls on roll block 25 in a manner analogous to FIGS. 3*a* and 3*d*, and the press skin 5 is upset between the separating ram 16 and the blocks and buckles and is bent open until the disc 3 is freed by the section 31 of the press skin 5. The press skin 5 will also in this instance remain in a single piece and during its passage through the separating head 6 is separated from the disc 3.

The highly stressed blocks consist of a wear-resistant steel. However, also blocks of tool steel and of interconnected sinter-ceramic parts may be employed for the separating edges, the rolling paths, and the sliding means.

Expediently, the respective described separating operation can be carried out directly following the extrusion pressing operation, i.e., in a still warm condition of the extruded material.

The distance B between the blocks cannot be absolutely fixed but is dependent on the respective extrusion pressed material.

It is, of course, to be understood that the present invention is, by no means, limited to the specific showing in the drawings but also comprises any modifications within the scope of the appended claims.

What we claim is:

1. A separating device for separating the ring-shaped press skin from a composite extrusion disc comprising a press disc and a stripper disc superimposed but spaced from each other by an annular intermediate space for receiving the press skin, especially for copper containing alloys and difficult to press metals and alloys, which includes in combination; a separating head having a passage therethrough, a slideway leading into said passage for receiving and slidingly supporting a composite extrusion disc from which the press skin is to be removed, and two blocks connected to said separating head and located opposite to each other while projecting into said passage so as to be able to engage the annular intermediate space between a press disc and a stripper disc of a composite extrusion disc to be freed from a press skin at said intermediate space when such composite extrusion disc enters said passage, the distance between said blocks being within the range of from the length of the inner diameter of the intermediate space of the composite extrusion disc to be stripped of the press skin thereon to the total length of said inner diameter plus the thickness of the press skin to be stripped.

2. A separating device in combination according to claim 1, which includes actuating means operable to feed a composite disc to be stripped of its press skin on said slideway through said passage.

3. A separating device in combination according to claim 1, in which said blocks have their surfaces which face each other arced so that the arc of one surface is the image of the other arc.

4. A separating device in combination according to claim 1, in which said blocks are provided with ripping edges located in one plane and extending in a direction transverse to the connecting line between said blocks.

5. A separating device in combination according to claim 1, in which said blocks are offset relative to each other in the direction in which a composite extrusion disc to be stripped of its press skin is to be passed through said passage, and in which the block to be engaged first by the composite disc to be stripped forms the front block and the other block forms the rear block, said front block being provided with a guidance roll path leading into a plane transverse to the direction of advancement of a composite disc to be stripped entirely of its press skin toward said separating head and having a transition guide area to straight guiding means forming part of said front block, said rear block having a ripping edge and an upsetting surface.

6. A separating device in combination according to claim 5, in which said rear block with its upsetting surface and its ripping edge is located in said plane transverse to the direction of advancement of a composite disc to be stripped entirely of its press skin toward said separating head.

7. A separating device in combination according to claim 5, in which the upsetting surface of said rear block is located ahead of said plane transverse to the direction of advancement of a composite disc to be stripped entirely toward said separating head.

* * * * *